US007270448B1

(12) United States Patent
Maley, Sr.

(10) Patent No.: US 7,270,448 B1
(45) Date of Patent: Sep. 18, 2007

(54) LIGHT FIXTURE HAVING AT LEAST TWO LEDS DIRECTED TOWARD CURVED SURFACE OF REFLECTOR

(75) Inventor: William B. Maley, Sr., Orange, CT (US)

(73) Assignee: Techlite Inc., Milford, CT (US)

( * ) Notice: Subject to any disclaimer, the term of this patent is extended or adjusted under 35 U.S.C. 154(b) by 94 days.

(21) Appl. No.: 10/999,460

(22) Filed: Dec. 1, 2004

(51) Int. Cl.
*F21V 5/00* (2006.01)

(52) U.S. Cl. ..... 362/334; 362/333; 362/335; 362/336; 362/338; 362/509; 362/543; 362/545; 362/800

(58) Field of Classification Search ..... 362/333–339, 362/509, 543, 545, 800
See application file for complete search history.

(56) References Cited

U.S. PATENT DOCUMENTS

| | | | | |
|---|---|---|---|---|
| 1,519,737 | A * | 12/1924 | Lyndon | 362/308 |
| 6,238,073 | B1 * | 5/2001 | Ito et al. | 362/544 |
| 6,641,284 | B2 * | 11/2003 | Stopa et al. | 362/240 |
| 2003/0016536 | A1 * | 1/2003 | Lin | 362/240 |

* cited by examiner

*Primary Examiner*—Stephen F. Husar
*Assistant Examiner*—Meghan K. Dunwiddie
(74) *Attorney, Agent, or Firm*—John H. Crozier

(57) ABSTRACT

In a preferred embodiment, an apparatus, including: a light fixture having a concave reflector disposed on a rear surface thereof; and at least one LED directed at a concavity of the concave reflector.

7 Claims, 7 Drawing Sheets

Horizontal Sweep at Zero degrees Vertical

| Min | Med | Max | FRA | Horz | Step |
|---|---|---|---|---|---|
| 4 | 5 | 7 | | -45 | 1 |
| 11 | 13 | 20 | | -40 | 2 |
| 38 | 48 | 79 | | -35 | 3 |
| 27 | 86 | 108 | | -30 | 4 |
| 84 | 108 | 148 | | -25 | 5 |
| 109 | 141 | 212 | | -20 | 6 |
| 139 | 276 | 476 | 50 | -15 | 7 |
| 273 | 393 | 505 | 67 | -10 | 8 |
| 238 | 331 | 439 | 83 | -5 | 9 |
| 313 | 420 | 774 | 100 | 0 | 10 |
| 250 | 328 | 439 | 83 | 5 | 11 |
| 233 | 344 | 672 | 67 | 10 | 12 |
| 222 | 354 | 544 | 50 | 15 | 13 |
| 105 | 150 | 212 | | 20 | 14 |
| 78 | 109 | 131 | | 25 | 15 |
| 63 | 87 | 112 | | 30 | 16 |
| 40 | 65 | 83 | | 35 | 17 |
| 13 | 19 | 29 | | 40 | 18 |
| 4 | 6 | 7 | | 45 | 19 |

Horizontal Sweep at (+) 5 degrees

| Min | Med | Max | FRA | +5 | Step |
|---|---|---|---|---|---|
| 4 | 5 | 7 | | -45 | 1 |
| 9 | 13 | 28 | | -40 | 2 |
| 33 | 46 | 78 | | -35 | 3 |
| 55 | 81 | 101 | | -30 | 4 |
| 62 | 94 | 119 | | -25 | 5 |
| 80 | 115 | 167 | | -20 | 6 |
| 102 | 227 | 355 | 50 | -15 | 7 |
| 171 | 248 | 380 | 50 | -10 | 8 |
| 144 | 230 | 360 | 50 | -5 | 9 |
| 186 | 331 | 531 | 50 | 0 | 10 |
| 161 | 247 | 382 | 50 | 5 | 11 |
| 163 | 226 | 310 | 50 | 10 | 12 |
| 127 | 200 | 351 | 50 | 15 | 13 |
| 66 | 102 | 142 | | 20 | 14 |
| 52 | 80 | 106 | | 25 | 15 |
| 38 | 66 | 84 | | 30 | 16 |
| 27 | 43 | 64 | | 35 | 17 |
| 11 | 15 | 27 | | 40 | 18 |
| 4 | 5 | 7 | | 45 | 19 |

Horizontal Sweep at (-) 5 degrees

| Min | Med | Max | FRA | -5 | Step |
|---|---|---|---|---|---|
| 3 | 4 | 5 | | -45 | 1 |
| 6 | 9 | 14 | | -40 | 2 |
| 15 | 21 | 51 | | -35 | 3 |
| 28 | 37 | 85 | | -30 | 4 |
| 38 | 46 | 99 | | -25 | 5 |
| 47 | 61 | 128 | | -20 | 6 |
| 60 | 71 | 280 | 50 | -15 | 7 |
| 77 | 115 | 390 | 50 | -10 | 8 |
| 50 | 117 | 290 | 50 | -5 | 9 |
| 69 | 138 | 425 | 50 | 0 | 10 |
| 70 | 134 | 282 | 50 | 5 | 11 |
| 84 | 149 | 346 | 50 | 10 | 12 |
| 63 | 141 | 370 | 50 | 15 | 13 |
| 36 | 83 | 125 | | 20 | 14 |
| 44 | 66 | 95 | | 25 | 15 |
| 35 | 58 | 83 | | 30 | 16 |
| 20 | 43 | 64 | | 35 | 17 |
| 7 | 13 | 25 | | 40 | 18 |
| 4 | 5 | 7 | | 45 | 19 |

LIGHT FIXTURE HAVING AT LEAST TWO LEDS DIRECTED TOWARD CURVED SURFACE OF REFLECTOR

BACKGROUND OF THE INVENTION

1. Field of the Invention

The present invention relates to light fixtures generally and, more particularly, but not by way of limitation, to a novel light fixture that is especially useful as a rear end marker for trains operating in the United States.

2. Background Art

While the present invention is described with reference to providing a rear end marking device for trains, the present invention is useful in a variety of applications.

In November 1977, the Federal Railway Administration (FRA) in response to a Law passed by Congress provided a Final Report covering guidelines for testing rear end marking devices for all trains operating in the United States. The Law was in reaction to a serious rear end collision where many passengers were injured and some were killed. The guidelines require a minimum of 100 candela straight on and 50 candela at plus and minus 15 degrees in the horizontal plane. The guidelines also required 50 candela at plus and minus 5 degrees straight on in the vertical plane. The maximum light level allowed is 1,000 candela. All light intensities were measured at the light source.

All fixtures at that time were lighted by incandescent lamps. Many of these lamps had a lamp life of 800 hours which presented a maintenance cost to the railroads because of frequent lamp replacements. The incandescent lamps also presented a safety problem, since, upon failure of an incandescent lamp, the lamp immediately becomes unlighted. With the development of LEDs having a long life, estimated in the 50,000 hour range, interest developed in creating LED rear end marker lights for trains. New lights were developed with many LEDs, perhaps as many as 50-70 LEDs facing away from the reflectors, and are now very common in traffic lights. An advantage of LEDs over conventional incandescent lamps, in addition to having a much longer life, is that, when LEDs age, they typically become darker and do not immediately become unlighted.

Accordingly, it is a principal object of the present invention to provide a light fixture that uses only a few LEDs.

A further object of the present invention is to provide such a light fixture that achieves the required oval pattern without wasting light energy in the vertical area above and below the horizontal pattern required by the FRA guidelines.

An additional object of the invention is to provide such a light fixture that achieve the required light beam with light energy distributed in a cone required by the guidelines in a very efficient manner.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an apparatus, comprising: a light fixture having a concave reflector disposed on a rear surface thereof; and at least one LED directed at a concavity of said concave reflector.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
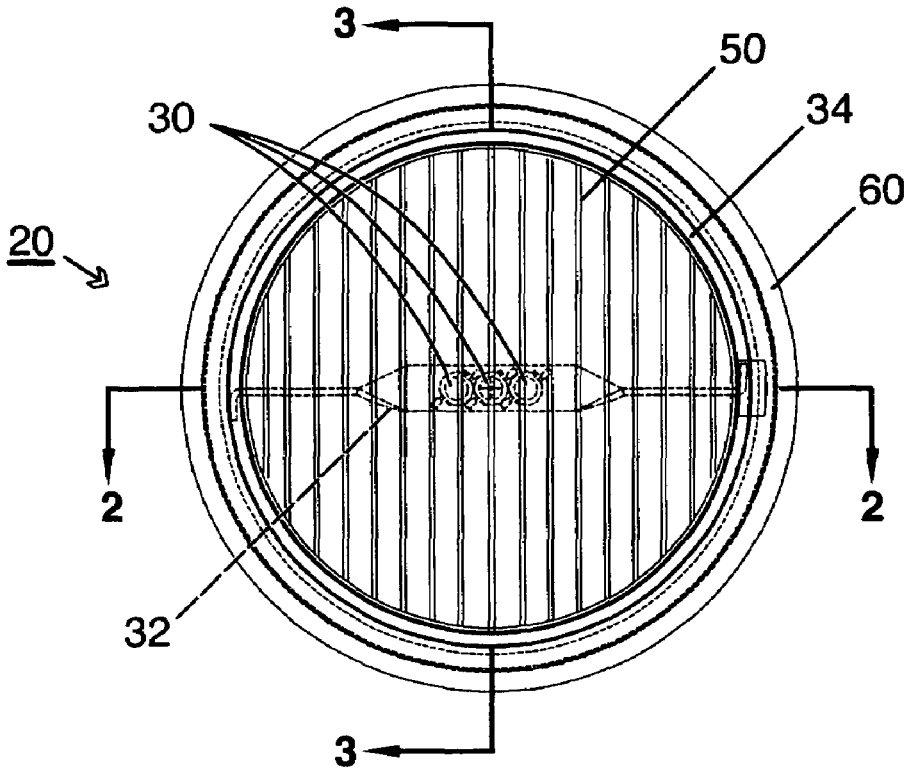
FIG. 1 is front elevational view of a light fixture constructed according to the present invention.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

Figure 2:
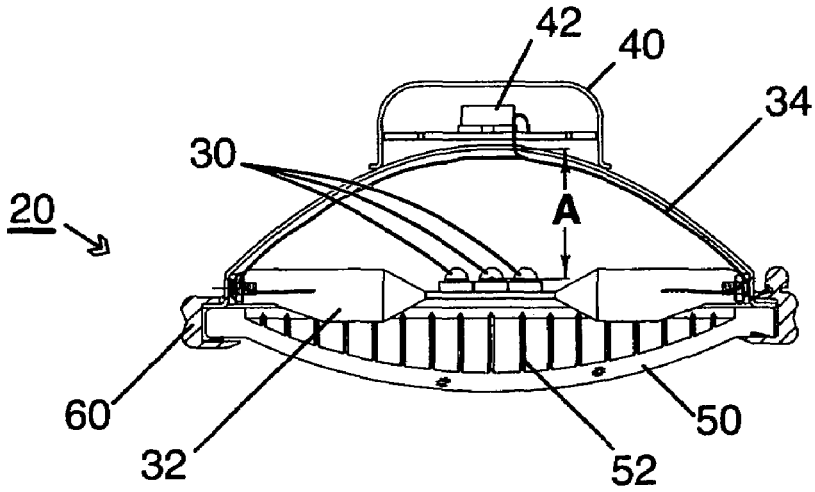
FIG. 2 is a top plan view of the light fixture taken along line "2-2" of FIG. 1.
Figure 3:
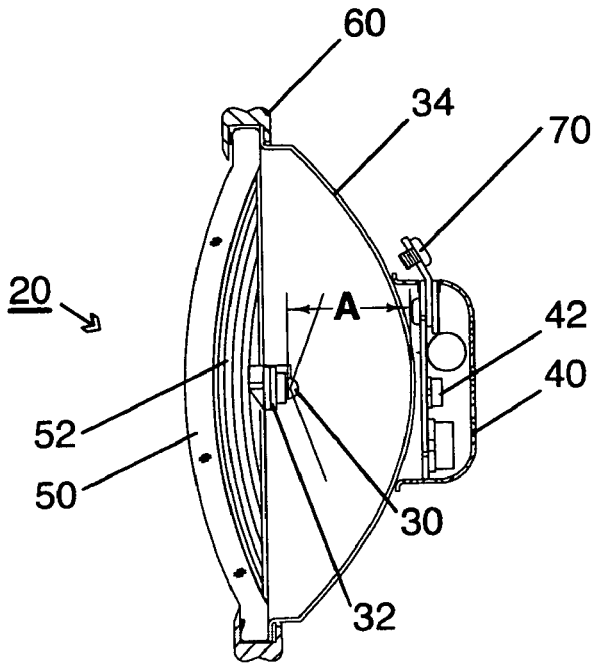
FIG. 3 is a side elevational view of the light fixture taken along line "3-3" of FIG. 1.

FIGS. 1-3 illustrate a light fixture, constructed according to the present invention, and generally indicated by the reference numeral 20.

Referring principally to FIG. 2, light fixture 20 includes three horizontally disposed LEDs 30 fixedly attached side-by-side to the center of an LED yoke assembly 32 and facing a parabolic reflector 34, the middle LED disposed at the focal point of the parabolic reflector, and with the yoke assembly horizontally disposed at the center of the parabolic reflector. A housing 40 fixedly disposed on the rear surface of parabolic reflector 34 contains circuit control circuitry and drivers 42 for LEDs 30.

Hermetically sealed to parabolic reflector 34 is a conventional spread lens 50 having vertical ribs, as at 52, formed on the rear surface thereof. A gasket 60 surrounds the front of light fixture 20 and creates a waterproof seal between the light fixture and the car body lamp fixture (not shown). All other seams are sealed with silicone sealant.

The two off-center LEDs 30 produce beams on either side of the beam produced by the center LED, thus producing the desired energy saving oval pattern.

Although values and dimensions may be varied, light fixture 20 may be 5.8 inches in diameter. LEDs 30 may be 1-watt LEDs as furnished by Luxeon as Part Number LXHL-PH01. Parabolic reflector 34 may have a focal point, dimension "A", of 1.25 inches. Lens 50 is preferably formed of red glass. Plastic may be used, but plastic even when coated is not as durable as glass. Also, lens 50 may be clear, since LEDs 30 are red, but persons are familiar with having a red lens. Screw terminal 70 is provided for attachment of a source of electrical power.

Figure 4:
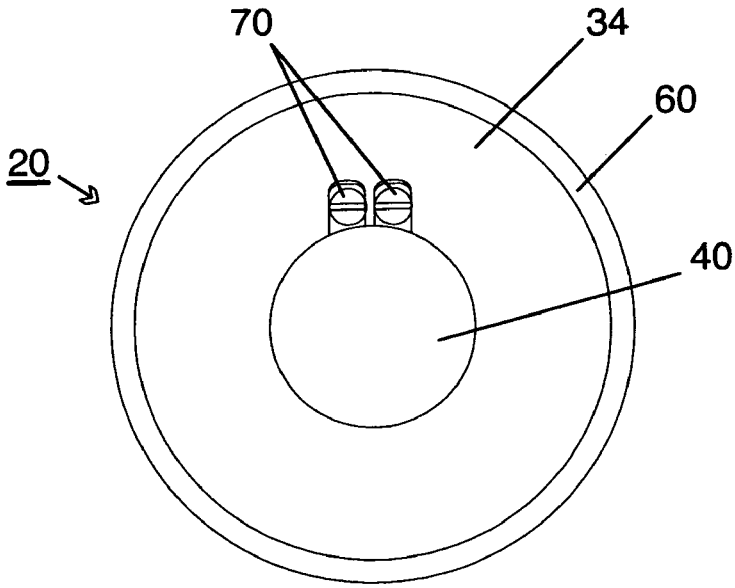
FIG. 4 is a rear elevational view of the light fixture.

FIG. 4 illustrates the rear of light fixture 20 and shows screw terminals 70 which may receive 37.5- or 75-volt power, depending on the railroad car on which light fixture 20 is mounted.

Figure 5:
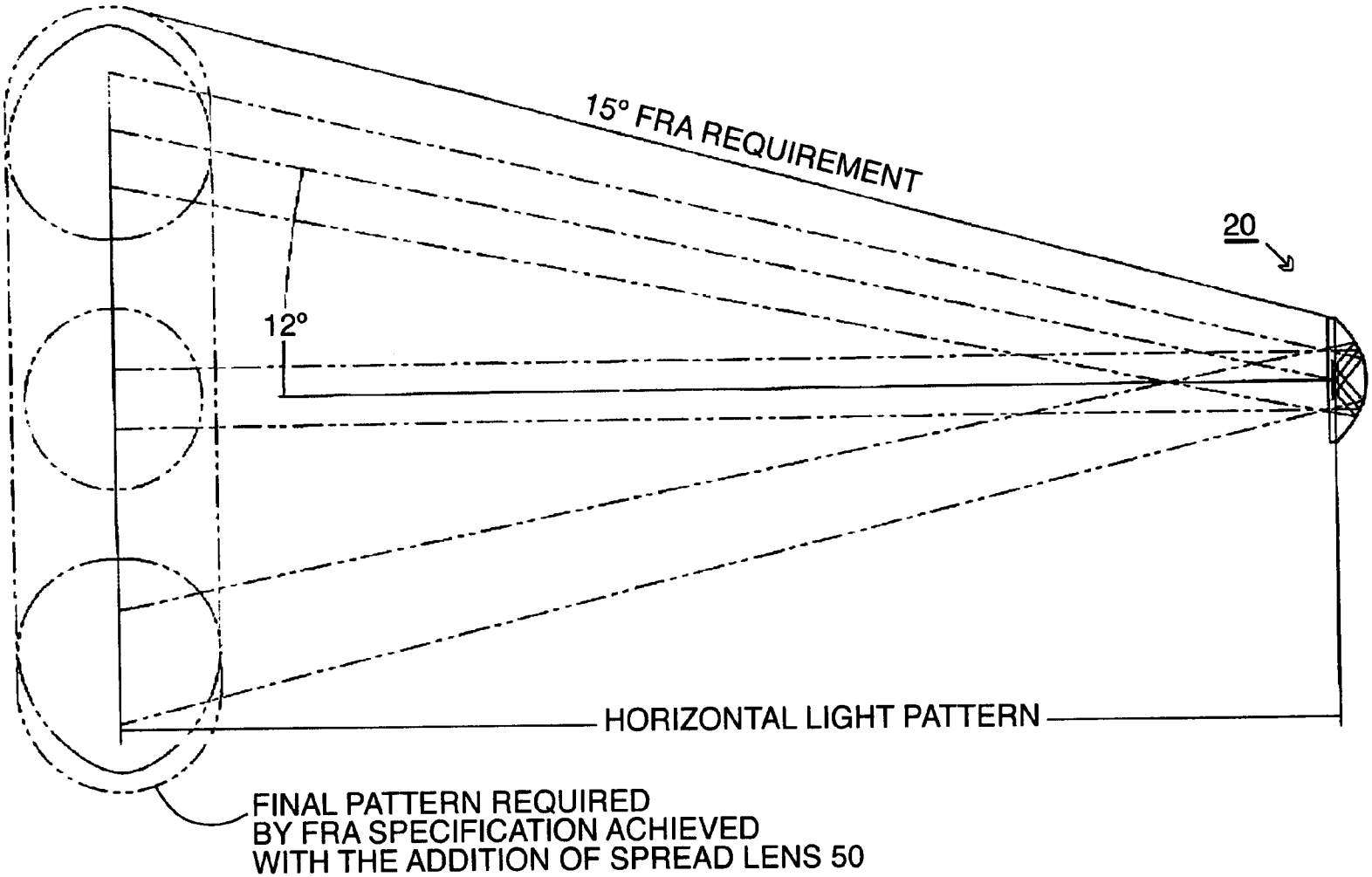
FIG. 5 is a schematic top plan view of the light pattern produced by the light fixture of FIG. 1.

FIG. 5 illustrates the horizontal light pattern produced by light fixture 20 and illustrates that lens 50 (FIG. 3) spreads the three beams produced by LEDs 30 (FIG. 2) to a relatively smooth oval pattern in the area of interest.

Figure 6:
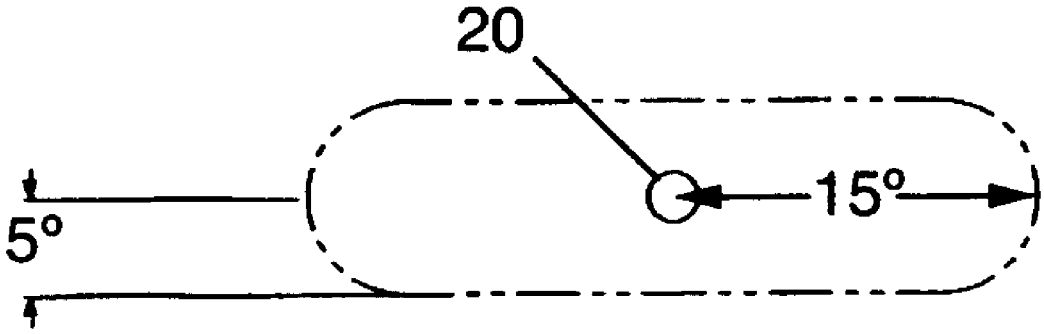
FIG. 6 is a schematic front plan view of the light pattern produced by the light fixture of FIG. 1.
Figure 7:
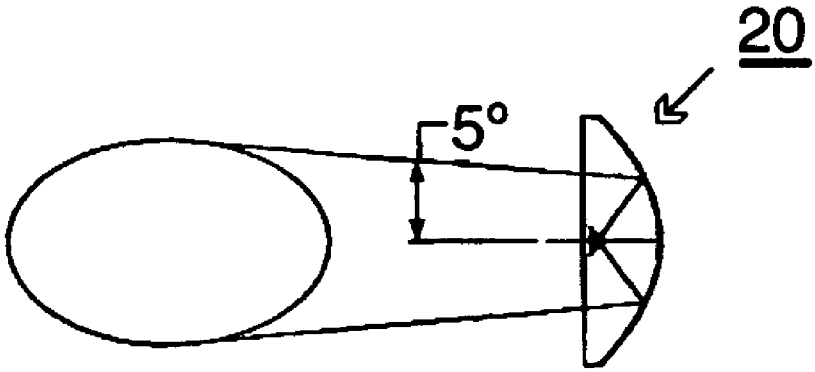
FIG. 7 is a schematic side elevational view of the light pattern produced by the light fixture of FIG. 1.

FIGS. 6 and 7 illustrate further the light pattern produced by light fixture 20.

Figure 8:
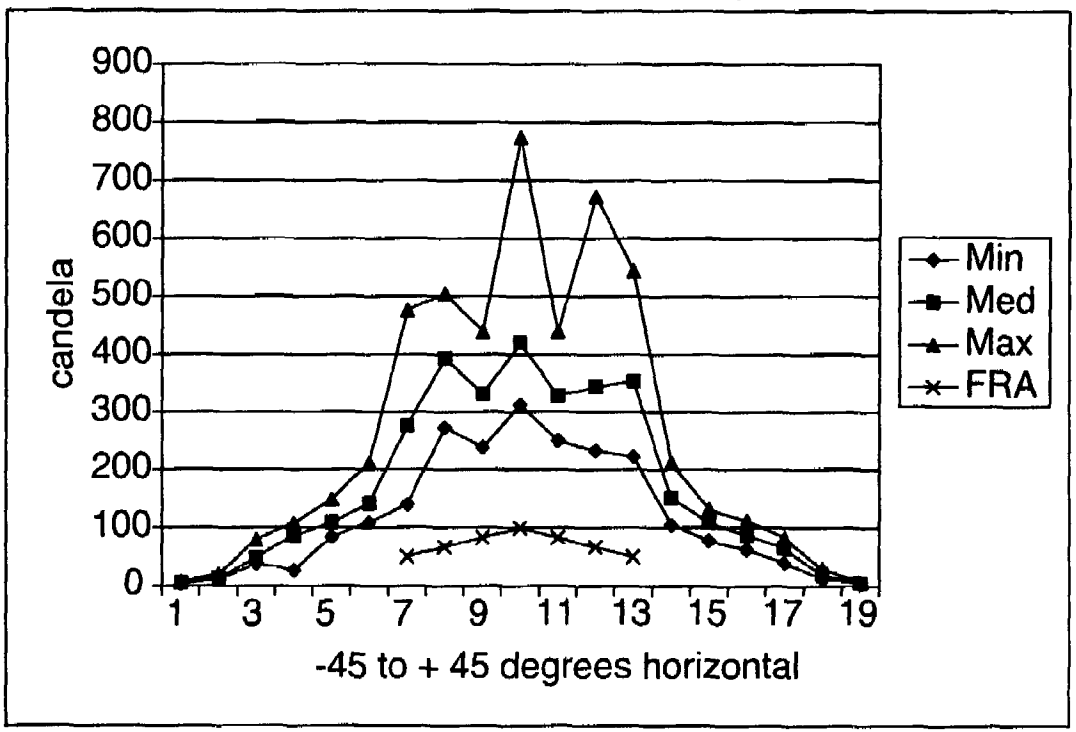
FIG. 8 shows the horizontal sweep test pattern of light produced by the light fixture of FIG. 1 at zero degrees vertical.
Figure 9:
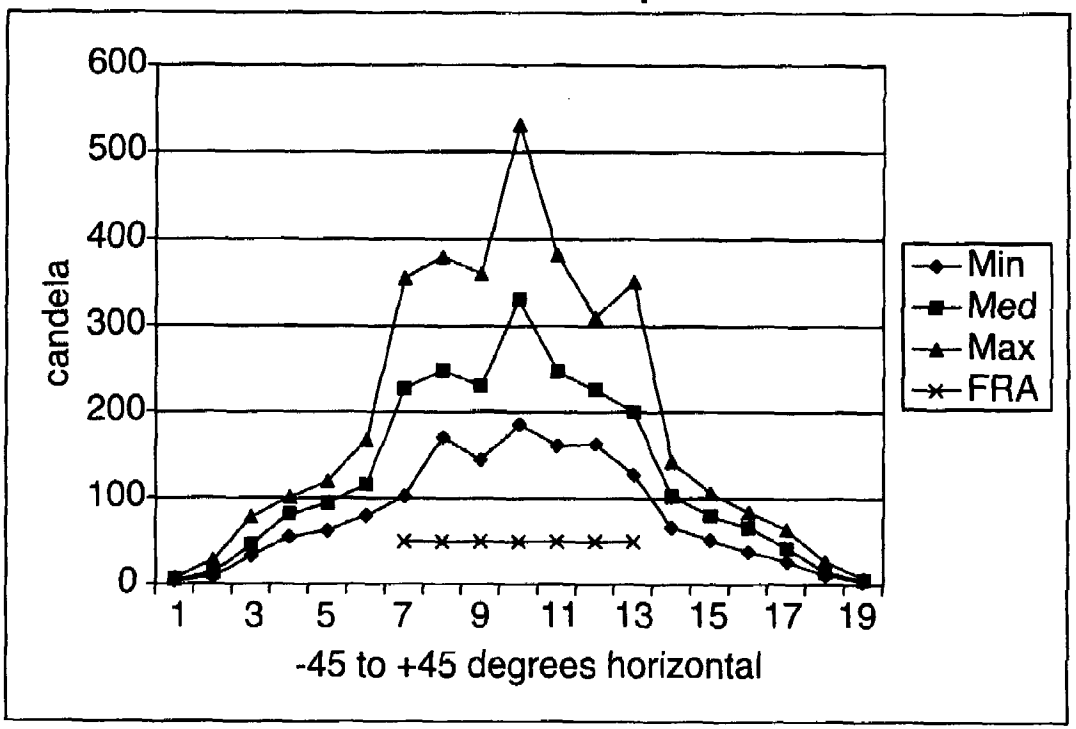
FIG. 9 shows the horizontal sweep test pattern of light produced by the light fixture of FIG. 1 at plus five degrees vertical.
Figure 10:
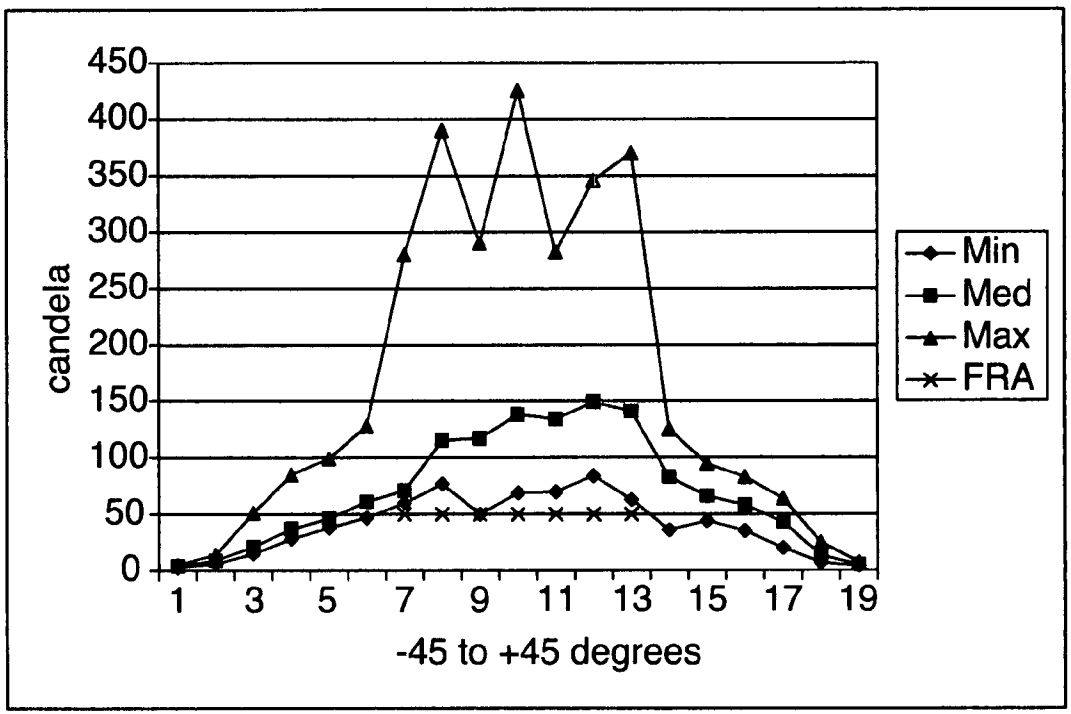
FIG. 10 shows the horizontal sweep test pattern of light produced by the light fixture of FIG. 1 at minus five degrees vertical.

FIGS. 8-10 illustrates test data taken at horizontal sweeps at zero degrees vertical, plus five degrees vertical, and minus five degrees vertical, respectively. It can be seen from these figures that the light pattern produced by light fixture 20 is relatively uniform over the area of interest and that the light intensity is equal to or exceeds that required by the FRA guidelines.

By not wasting energy, this design cuts in half the power required when compared to existing designs, thereby making long hours of operation possible on the rear of freight trains. Lights on the rear of freight trains are operated from batteries which require recharging at intermittent service areas.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The invention claimed is:

1. An apparatus, comprising:

(a) a light fixture having a smooth concave reflector disposed on a rear surface thereof;

(b) at least two LEDs directed at a concavity of said smooth concave reflector;

(c) said at least two LEDs are disposed horizontally and centrally in said light fixture;

(d) said at least two LEDs are disposed in said light fixture on either side of a center to produce a desired energy saving oval pattern; and (e) wherein said at least two LEDs are three LEDs in number, said three LEDs are disposed horizontally in said light fixture at or near a center of said smooth concave reflector, and light output from said light fixture meets requirements for rear end marker lights for railroad trains.

2. An apparatus, as defined in claim 1, further comprising a spread lens disposed over a front of said light fixture, said spread lens having its concavity directed toward a concavity of said smooth concave reflector.

3. An apparatus, as defined in claim 1, wherein said smooth concave reflector is a parabolic reflector.

4. An apparatus, as defined in claim 1, wherein said at least two LEDs are disposed at or near a center of said smooth concave reflector.

5. An apparatus, as defined in claim 3, wherein said at least two LEDs are mounted on a yoke.

6. An apparatus, as defined in claim 4, wherein said yoke is horizontal.

7. An apparatus, as defined in claim 1, wherein two off-center LEDs produce beams on either side of a center LED beam, the LEDs being said three in number, producing said desired energy saving oval pattern.

* * * * *